United States Patent [19]

Crocker

[11] 4,381,740

[45] May 3, 1983

[54] RECIPROCATING ENGINE

[76] Inventor: Alfred J. Crocker, 4906 Naomi Dr., Toledo, Ohio 43623

[21] Appl. No.: 146,672

[22] Filed: May 5, 1980

[51] Int. Cl.[3] ..... F02B 75/26

[52] U.S. Cl. ..... 123/58 AA; 123/44 E

[58] Field of Search ..... 123/56 R, 56 C, 56 A, 123/56 AC, 58 R, 58 AA, 58 A, 43 C, 44 E, 55 R, 197 R, 197 A, 197 AC, 55 A, 55 AA

[56] References Cited

U.S. PATENT DOCUMENTS

| | | | |
|---|---|---|---|
| 1,122,972 | 12/1914 | Maye | 123/44 E |
| 1,485,988 | 3/1924 | Michel | 123/55 AA |
| 1,711,260 | 4/1929 | Caminez | 123/55 AA |
| 1,765,713 | 6/1930 | Boland | 123/55 AA |
| 1,829,780 | 11/1931 | Beytes et al. | 123/55 AA |
| 1,863,877 | 6/1932 | Rightenour | 123/55 SR |
| 3,274,982 | 9/1966 | Noguchi et al. | 123/55 AA |

FOREIGN PATENT DOCUMENTS

| | | | |
|---|---|---|---|
| 420417 | 1/1911 | France | 123/43 C |
| 775736 | 1/1935 | France | 123/55 AA |
| 12336 | of 1910 | United Kingdom | 123/55 AA |

*Primary Examiner*—Craig R. Feinberg

*Attorney, Agent, or Firm*—Wilson, Fraser, Barker & Clemens

[57] ABSTRACT

A reciprocating piston engine is provided with cyclinders arranged radially about a rotatable drive shaft and a separate piston adapted to reciprocate in each cylinder. Each piston is held in contact with a cam mounted on the shaft by means of linkages and rollers. The cam profile provides greater time for the power portion of the engine cycle than for the exhaust portion of the engine cycle. In a four-cycle engine, greater time also is provided for the intake portion of the cycle than for the compression portion of the cycle.

2 Claims, 4 Drawing Figures

FIG. 2
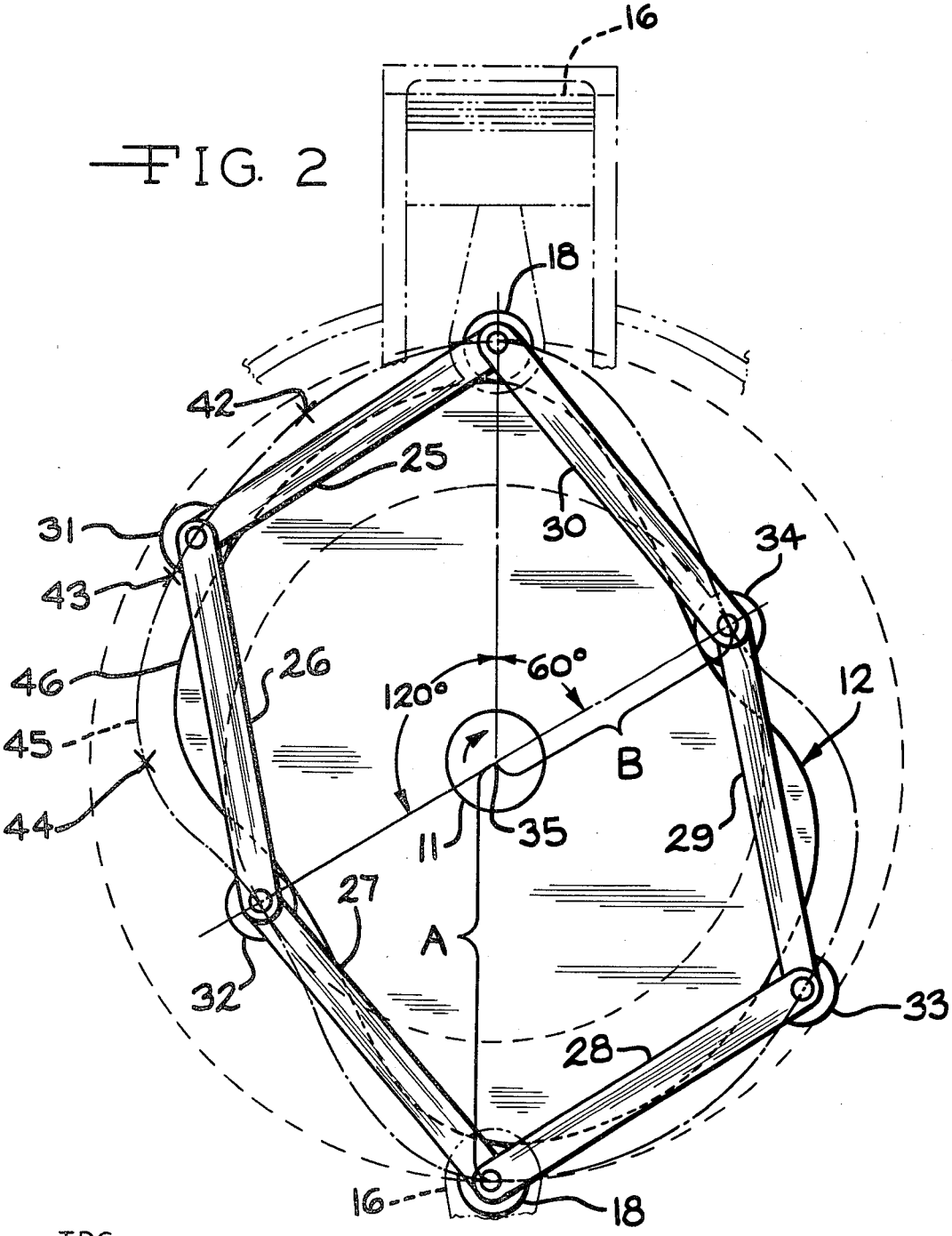
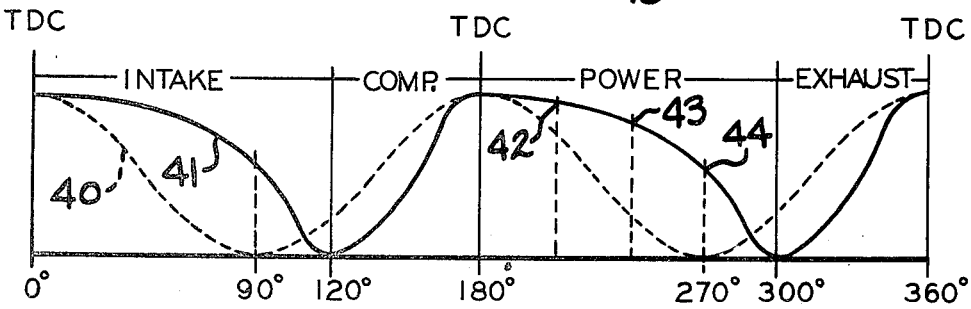
FIG. 3

RECIPROCATING ENGINE

BACKGROUND OF THE INVENTION

This invention relates to reciprocating piston engines and more particularly to engines in which reciprocating pistons transmit their thrust to a drive shaft by means of rollers which engage a cam mounted on the drive shaft.

In one common type of reciprocating piston engine, pistons are connected through a connecting rod to a crank on a crank shaft. The piston moves in one direction in the cylinder as the crank shaft rotates through 180° and moves in the opposite direction during the next 180° of rotation. In a four cycle internal combustion engine, the crank shaft rotates sequentially through 180° during an intake stroke of the piston, through 180° during a compression stroke of the piston, through 180° during a combustion or power stroke of the piston and through a final 180° during an exhaust stroke of the piston. Each stroke of the piston is inherently confined to 180° rotation of the crank shaft. Such an arrangement does not provide maximum efficiency in the engine cycle, particularly with relatively slow burning fuels.

In another type of reciprocating piston internal combustion engine, such as is illustrated in the U.S. Pat. No. 1,765,713, cylinders are arranged radially about a drive shaft. Each piston within a cylinder is attached to a roller which is held in contact with a first cam mounted on the drive shaft. Linkages and a second set of rollers riding on a second cam on the drive shaft hold the rollers attached to the pistons in contact with the first cam so that as the pistons reciprocate, the cam is caused to rotate to in turn rotate the drive shaft. In order to maintain the rollers attached to the piston in contact with the cam, the second cam has a different profile from the first cam. A modification of this type of engine is illustrated in U.S. Pat. No. 1,863,877 in which a spring loaded strap extends over sets of rollers to hold the rollers attached to the pistons in contact with the cam. The cam illustrated in this patent has major and minor diameters which are displaced from one another by less than 90° so that the power and intake strokes of the piston occur over 35° of shaft rotation and the compression and exhaust strokes of the pistons occur over 55° of shaft rotation. This arrangement appears to provide less efficiency over conventional engines having a crank shaft for converting reciprocating motion to rotary motion since intake and power portions of the cycle take place over a smaller percentage of the total cycle than the compression and exhaust portions of the cycle. Furthermore, a complicated arrangement is required for holding the piston mounted rollers in contact with the cam.

SUMMARY OF THE INVENTION

According to the present invention, an improved reciprocating engine is provided of the type having cylinders radially arranged about a drive shaft. Each cylinder has a reciprocating piston which is attached either directly or through a connecting rod to a roller. The piston connected rollers are held in contact with a cam mounted on the drive shaft by means of six equal linkages and rollers which engage the cam. The cam is symmetrical in cross-section in that all diameters have midpoints coincident with the drive shaft axis. The cam is designed with a major diameter and a minor diameter which are displaced from one another by other than 90° so that intake and power strokes of the engine, for a four cycle engine, take place over greater than 90° of shaft rotation and compression and exhaust strokes take place over less than 90° of shaft rotation to provide greater efficiency in the engine, particularly when the engine is operated at higher speeds with relatively slow burning fuels.

Accordingly, it is an object of the invention to provide an improved efficiency reciprocating piston internal combustion engine.

Another object of the invention is to provide a reciprocating piston internal combustion engine with a power stroke having a longer duration than a compression stroke.

Still another object of the invention is to provide a four cycle reciprocating piston internal combustion engine with intake and power strokes longer in duration than compression and exhaust strokes.

Other objects and advantages of the invention will become apparent from the following detailed description, with reference being made to the accompanying drawings.

BRIEF DESCRIPTION OF THE DRAWINGS

FIG. 2 is a fragmentary diagrammatic view of an internal combustion engine constructed in accordance with one embodiment of the invention and showing the cam profile, the linkages and the rollers for converting reciprocating motion to rotary motion;

FIG. 3 is a graph illustrating an exemplary cycle of the engine of the present invention.

DESCRIPTION OF THE PREFERRED EMBODIMENTS

Figure 1:
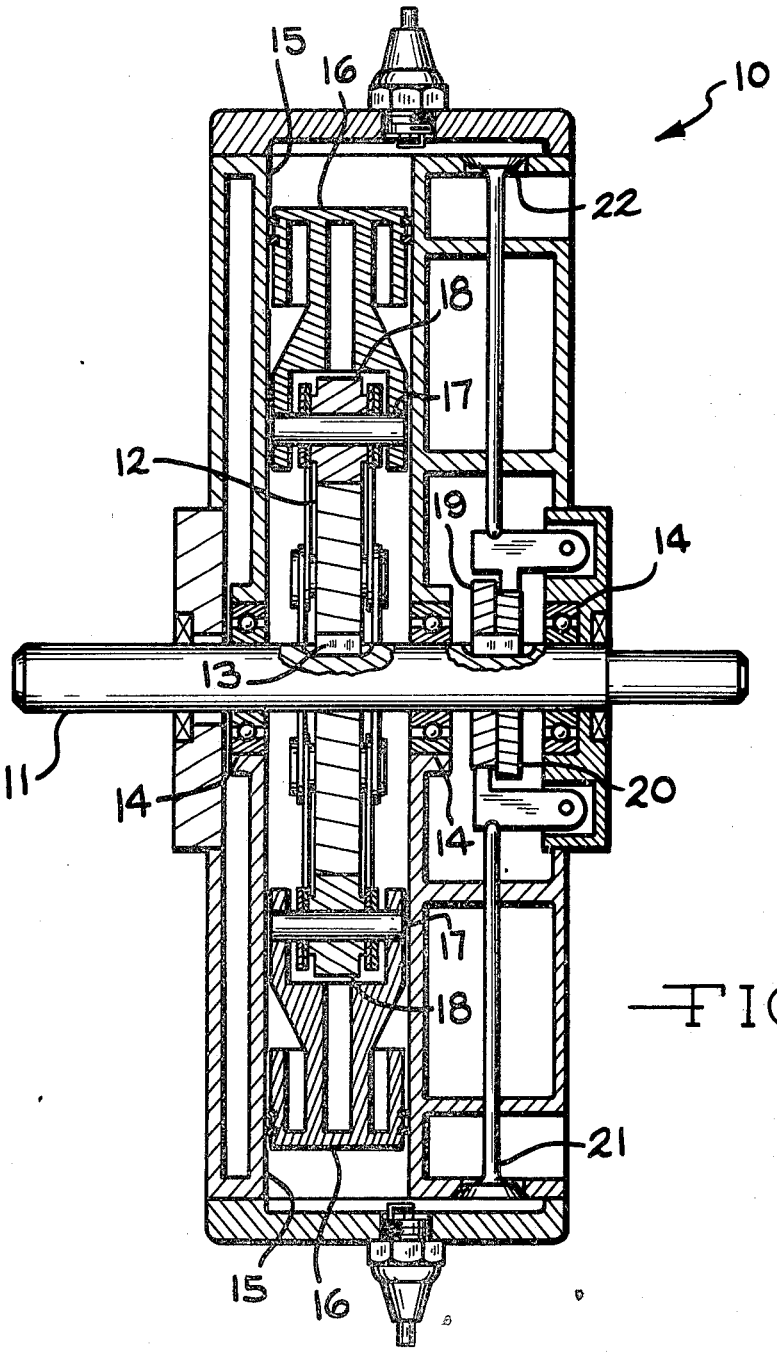
FIG. 1 is a cross-sectional view through a reciprocating piston internal combustion engine constructed in accordance with the present invention.

Turning now to the drawings and particularly to FIG. 1, a fragmentary cross-sectional view is shown through a reciprocating piston internal combustion engine 10 constructed in accordance with the invention. The engine 10 generally includes a drive shaft 11 to which a cam 12 is attached by means of a key 13. The shaft 11 and attached cam 12 rotate on a plurality of bearings 14. The engine 10 preferably includes at least two-cylinders 15 extending radially outwardly from the shaft 11. A separate piston 16 is positioned in each cylinder 15 for reciprocating towards and away from the shaft 11. Each piston 16 is connected through a pin 17 to a roller 18 which rides on the cam 12. For a four cycle engine, as the shaft 11 and cam 12 rotate, the cam 12 forces the pistons 16 outwardly away from the shaft 11 during compression and exhaust strokes and pulls the pistons 16 radially inwardly towards the shaft 11 during the intake stroke, and the piston 16 applies power to rotate the cam 12 during the power stroke.

The engine 10 may be provided with any suitable conventional valve arrangement for supplying an air/fuel mixture to the cylinders 15 during the intake stroke of the piston 16 and for venting exhaust gases from the cylinders 15 during the exhaust stroke of the piston 16. In the exemplary engine 10 in FIG. 1, two cams 19 and 20 are provided for operating valves 21 and 22, respectively, for supplying an air/fuel mixture to or exhausting gases from two cylinders. Of course, the engine 10 may be of other designs, such as a diesel engine, in which fuel is injected directly into the cylinder.

Turning now to FIG. 2, a diagrammatic fragmentary portion of the engine 10 illustrates the shape and operation of the cam 12 for rotating the shaft 11 and moving the piston 16. The upper one of the pistons 16 is shown attached to the roller 18 which rides on the cam 12 and only a fragmentary portion of the lower piston 16 is shown attached to the roller 18 which also rides on the cam 12. Six linkages 25–30 are illustrated extending about the cam 12. The linkages 25–30 are each of identical length and adjacent ones of the linkages 25–30 are pivotally connected together. The adjacent linkages 25 and 26 are connected together and pivotally attach to an idler roller 31 which rides on the cam 12. Similarly, the adjacent linkages 26 and 27 are pivotally connected together and are connected to an idler roller 32 which rides on the cam 12. The adjacent linkages 28 and 29 are pivotally connected together and are connected to an idler roller 33 which rides on the cam 12 and the adjacent linkages 29 and 30 are pivotally connected together and are connected to an idler roller 34 which rides on the cam 12. The adjacent linkages 25 and 30 are pivotally connected together and are connected to one of the rollers 18 which in turn is connected to a piston 16 and the adjacent linkages 27 and 28 are pivotally connected together and are connected to the other roller 18 which is connected to the other piston 16. The cam 12 is designed in combination with the linkages 25–30 so that, as the cam 12 rotates, each of the rollers 18 and 31–34 stay in contact with the cam 12.

The design of the cam 12 is best illustrated by referring to both FIGS. 2 and 3. Preferably, the cam 12 is symmetrical about a center of rotation 35 for the shaft 11 and the cam 12. In other words, it is preferable to have the center of rotation 35 located at the midpoint of each diameter for the cam 12. This arrangement provides dynamic balancing as the cam 12 rotates at high velocities. However, it should be noted that the cam 12 may be asymmetric and provided with necessary dynamic balancing weights for high velocity operation. The cam pattern is provided with a major diameter which is a maximum distance between the axes of any two opposed rollers. Such as the two rollers 18, as the cam 12 rotates. The cam 12 also has a minor diameter which is a minimum distance between the axes of the two opposed rollers 18 as the cam 12 rotates. The major diameter has a semi-diameter length A and the minor diameter has a semi-diameter length B, as labeled in FIG. 2. The stroke of each piston 16 is the difference between the major and minor semi-diameters A and B.

The major and minor semi-diameters A and B are displaced from one another by an angle other than 90°. This displacement is in a direction to provide greater time for the intake and power strokes and a four cycle engine than is provided for the compression and exhaust strokes. For example, in the illustrated cam 12, the major and minor semi-diameters are spaced apart to provide 120° of shaft rotation for the intake stroke, 60° of shaft rotation for the compression stroke, 120° of shaft rotation for the power stroke and 60° of shaft rotation for the exhaust stroke. This arrangement provides greater efficiency in the engine, particularly at higher engine speeds with relatively slowly burning fuels.

In a reciprocating piston engine, a valve is opened during the intake portion of the cycle and fresh air or an air/fuel mixture is drawn into the cylinder as the piston moves downwardly in the cylinder. In nonsupercharged engines, there is a relatively low pressure differential causing the fresh air or air/fuel mixture to flow into the cylinder during the intake portion of the cycle. By providing a greater time for this portion of the cycle, the engine is more efficiently charged with fresh air or with an air/fuel mixture. This is particularly true at higher engine speeds where very little time is provided for intake. A greater time also is provided during the power portion of the cycle. This greater time interval allows for a release of working pressure over a wider angle of shaft rotation. Furthermore, the additional time for the power portion of the cycle results in a greater pressure on the piston at the end of the power stroke since there is more time for completion of combustion. On the other hand, the time required for the compression and exhaust portions of the cycle is not critical and, by shortening the time for these portions of the cycle, additional time is provided for the intake and power portions of the cycle.

The design of the cam 12 is illustrated in FIG. 2 and the graph in FIG. 3. A dashed line 40 in FIG. 3 illustrates the position of a piston versus drive shaft rotation for a conventional reciprocating piston engine having a crank shaft. However, it should be noted that the degrees indicated along the bottom of the chart are one-half the actual value since the crank shaft rotates through 720° or two complete revolutions for a full cycle. In other words, the intake, compression, power and exhaust portions of the cycle each require 180° of rotation of the crank shaft. A line 41 illustrates the position of the piston as the shaft 11 and cam 12 rotate 360°. In the illustrated embodiment, the shaft 11 and cam 12 rotate through 120° for the intake stroke, through 60° for the compression stroke, through 120° for the power stroke and finally through 60° for the exhaust stroke of the piston. It should be noted that during the power stroke, the piston initially moves very little to allow pressure buildup which is finally released over the latter part of the stroke. The actual curve for the power stroke is selected to provide desired operating characteristics to the engine.

In designing the pattern for the cam 12, the initial step is to determine a desired displacement for the reciprocating pistons 16. From this selected displacement, the major semi-diameter A and the minor semi-diameter B are selected. Several points, points 42–44, on the line 41 representing the desired position of the piston versus angular rotation of the cam 12 are marked on the line 41 of the graph of FIG. 3. These points 42–44 are used for generating a cam pattern 45 for a portion of the cycle, such as for the illustrated power portion of the cycle. An actual cam profile 46 is formed from the cam pattern 45 by allowing for the radius of the rollers 18 and 31–34. In other words, the cam profile 46 corresponds to the cam pattern 45, only smaller by the radius of the rollers 18 and 31–34.

The links 25–30 are established at a uniform length normally equal to a line interconnecting the major and minor semi-diameters A and B only spaced apart by 60° about the center of rotation 35. The link 30 in FIG. 2, for example, illustrates this since it has pivot connections on its opposite ends lying on a circle formed about the center of rotation 35 having the radius A of the major semi-diameter and lying on a circle having the radius B of the minor semi-diameter for the cam 12.

After the portion of the cam profile 46 for the power stroke is established, the intake portion of the stroke preferably is made identical so that each diameter of this portion of the cam has a midpoint coincident with the center of rotation 35. The compression and exhaust portions of the cycle are generated by the rollers 32 and 34 as the cam 12 rotates and the rollers 18, 31 and 33 move over the power and intake curves of the cam 12. By thus generating the cam profile for the compression and exhaust portions of the engine cycle, the rollers 18 and 31–34 will all maintain contact with the cam 12 as the cam 12 is rotated through 360°.

Figure 4:
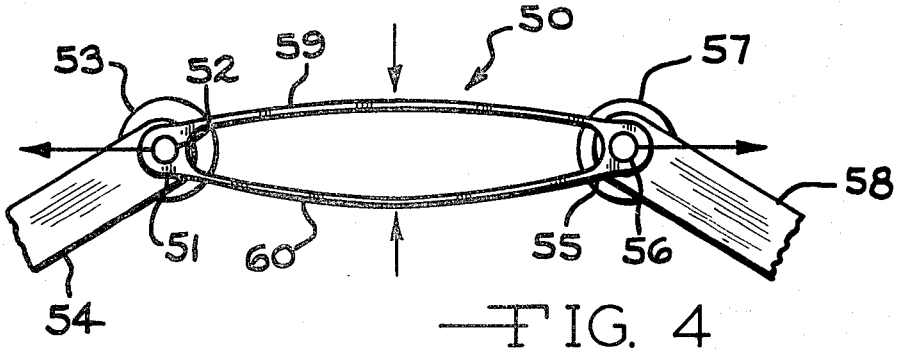
FIG. 4 is a side view of an expansion link for use in the engine of the present invention.

When a cold engine is initially started and has not reached its normal operating temperature, the cam 12 and the linkages 25–30 may be subjected to thermal stresses for a short period of time which temporarily produce non-uniform thermal expansion of the cam 12 and/or of the linkages 25–30. If desired, either all of the links or the two opposed links such as the links 26 and 29, may be replaced with expandable links, such as the link 50 illustrated in FIG. 4. The link 50 has an end 51 connected by a pivot pin 52 to a roller 53 and also to an adjoining link 54 and has a second end 55 connected by a pivot pin 56 to a roller 57 and to an adjoining link 58. The link 50 is provided with two convex sides 59 and 60 which are formed from a spring material. As forces are exerted on the pins 51 and 56 tending to elongate the link 50, the sides 59 and 60 move together, as illustrated by arrows, allowing the rollers 53 and 57 to move apart slightly. Thus, the link 50 will maintain the rollers in contact with the cam 12 even though there is non-uniform thermal expansion during initial warm-up of the engine. An expandable link, such as link 50, also may be used for taking up slack as the cam and the rollers wear during extended use of the engine.

As stated above, the six links are selected to extend between circles formed by the major and minor semi-diameters over a 60° segment about the center of rotation of the cam. The cam profile is selected for one portion of the operating cycle of the engine, such as the power portion, and the profile is generated by the rollers for the next portion of the cycle, such as the exhaust portion. The generated cycles may be modified slightly by making slight, equal adjustments in the length of the links 25–30. In each case, the portion of the cycle which is generated is selected to maintain the rollers in contact with the cam surface. In establishing the size of the cam during the initial design, the stroke, which is, the difference between the major and minor semi-diameters, normally cannot exceed the minor semi-diameter, unless the lengths of the links are shortened. If the stroke does exceed the minor semi-diameter and the links are not shortened, two adjacent links will approach a straight line at times during the cycle and an unstable condition may result with the rollers moving out of contact with the cam. In some cases, the stroke may be selected to equal the minor semi-diameter. An unstable condition can be eliminated by slightly decreasing the lengths of the link which will in turn modify the generated portion of the cam pattern.

The above-described engine 10 has several benefits over prior reciprocating engines. By increasing the duration of the intake stroke, the volumetric efficiency is increased due to the greater proportional time for intake. By increasing the duration of the working or power stroke, the working pressure is released over a wider angle of shaft rotation and a higher pressure is maintained over a greater portion of the power stroke. Furthermore, the piston velocity and the piston ring seal velocity is at a minimum when the pressure on the piston is the highest. Finally, the engine design can allow for varying and selecting a desired movement of the piston in portions of the operating cycle of the engine. Still another advantage over engines of the type having a crank shaft is that the shaft of the engine 10 turns at one-half the normal speed of a conventional engine shaft, thereby reducing wear on the engine.

It will be appreciated that various modifications and changes may be made in the above-described engine 10 without departing from the spirit and scope of the invention. For example, the invention has been described as being embodied in a four cycle engine. The invention is equally applicable to a two cycle engine. The engine 10 has been described as having 120° of shaft rotation for the intake and power strokes and 60° of shaft rotation for the compression and exhaust strokes. The cam may be modified for other shaft rotations, such as 115° rotation for the intake and power strokes and 65° rotation for the compression and exhaust strokes. Generally, it does not appear to be desirable to exceed about 135° of shaft rotation for the intake and power strokes. However, in accordance with the present invention the power stroke will take place over greater than 90° of shaft rotation to provide an increased efficiency over prior art crank shaft type engines.

The engine 10 has been described as having a single cam for moving the pistons 16. It should be appreciated that additional pistons may be mounted about the cam such as three pistons or six pistons, and that additional cams may be mounted on the shaft 11 for driving additional pistons. Furthermore, it should be noted that the single cam 12 may be replaced with three cams spaced along the shaft 11 with the two outer ones of the cams identical and keyed to the shaft 11 and the inner one of the cams gear driven in the opposite direction so that the three cams simultaneously engage the piston rollers 18 for reciprocating the pistons 16. With this arrangement, no side loading forces are exerted on the pistons 16 or their connecting rods. As far as the linkages are concerned, an engine in accordance with the present invention must have at least six linkages in order to maintain proper contact between the rollers and the cam. A greater number of linkages may be provided if desired. However, the stroke of the engine must be reduced or the minor diameter must be increased when more than six linkages are used to prevent adjacent linkages from approaching an unstable straight line during rotation of the cam.

Various other modifications and changes may be made without departing from the spirit and the scope of the following claims.

What I claim is:

1. In a reciprocating piston engine having a rotatable shaft, at least one cylinder extending radially from the shaft, and a piston adapted to reciprocate in the cylinder, the improvement comprising: a cam attached to the shaft and having a peripheral camming surface defined by a major diameter and a minor diameter, the major and minor diameters intersecting at the axis of rotation of the rotatable shaft, at least six cam followers spaced about and in contact with the camming surface of said cam, at least six substantially equal length linkages, a separate one of said linkages extending between each two adjacent cam followers about said cam, said linkages maintaining said cam followers in contact with the camming surface of said cam as said cam and said shaft rotate, at least four of said cam followers adapted to travel in a circuitous closed loop path spaced from the axis of rotation as said cam and said shaft rotate, means connecting the piston to one of the other of said cam followers whereby the piston reciprocates as said cam rotates and said one cam follower travels in a radially linear path coaxial with said piston, and wherein the major and minor diameters of said cam are displaced from one another by other than 90° in a direction to reciprocate the piston outwardly from the shaft over less than 90° of shaft rotation and to reciprocate the piston inwardly toward the shaft over greater than 90° shaft rotation whereby the duration of the inward reciprocation of the piston is greater than the duration of the outward reciprocation of the piston.

2. The improved reciprocating piston engine of claim 1, wherein the piston moves sequentially through an intake stroke, a compression stroke, a power stroke and an exhaust stroke during each rotation of the shaft, said cam having identical camming surfaces for said intake and power strokes each extending over greater than 90° and no more than 135° of said cam and said cam having identical camming surfaces for said compression and exhaust strokes each extending over less than 90° of said cam.

* * * * *